US008556686B2

(12) United States Patent
Scott

(10) Patent No.: US 8,556,686 B2
(45) Date of Patent: Oct. 15, 2013

(54) DEVICE FOR SHARPENING AND POLISHING NEEDLES, PINS, AND MISCELLANEOUS POINTED ARTICLES

(75) Inventor: William S. Scott, Vancouver, WA (US)

(73) Assignee: AFAB Innovations, Inc., Vancouver, WA (US)

( * ) Notice: Subject to any disclaimer, the term of this patent is extended or adjusted under 35 U.S.C. 154(b) by 475 days.

(21) Appl. No.: 12/821,007

(22) Filed: Jun. 22, 2010

(65) Prior Publication Data

US 2011/0312258 A1 Dec. 22, 2011

(51) Int. Cl.
*B24D 15/00* (2006.01)

(52) U.S. Cl.
USPC ..... 451/523; 451/526; 451/527; 451/532

(58) Field of Classification Search
USPC ..... 451/523, 526, 527, 532
See application file for complete search history.

(56) References Cited

U.S. PATENT DOCUMENTS

| | | | | |
|---|---|---|---|---|
| 2,426,892 | A | 9/1947 | Mayer et al. | |
| 2,465,442 | A | 3/1949 | Gaylor | |
| 2,657,503 | A | 11/1953 | Gaines | |
| 2,766,644 | A | 10/1956 | Marks | |
| 3,092,081 | A | 6/1963 | Fraser | |
| 3,468,068 | A | 9/1969 | Spruell | |
| 4,069,528 | A | 1/1978 | Newton et al. | |
| D297,209 | S | 8/1988 | Cohen | |
| 4,991,355 | A | 2/1991 | Giles | |
| 4,993,099 | A * | 2/1991 | Emura et al. | 15/118 |
| D337,253 | S | 7/1993 | Glesser | |
| 5,287,661 | A * | 2/1994 | Benner | 451/555 |
| 6,056,627 | A * | 5/2000 | Mizuta | 451/59 |
| 6,306,187 | B1 | 10/2001 | Maeda et al. | |
| 6,428,407 | B1 * | 8/2002 | Elder | 451/530 |
| 2005/0198758 | A1 * | 9/2005 | Kunz | 15/118 |
| 2006/0003912 | A1 * | 1/2006 | Lindsay et al. | 510/267 |
| 2006/0277816 | A1 | 12/2006 | Scott | |

FOREIGN PATENT DOCUMENTS

| | | | |
|---|---|---|---|
| JP | 11-087438 | A | 3/1999 |

* cited by examiner

*Primary Examiner* — Lee D Wilson
*Assistant Examiner* — Shantese McDonald
(74) *Attorney, Agent, or Firm* — Rylander & Associates PC; Kurt M. Rylander; Philip R. Hunt

(57) ABSTRACT

A sharpening device with an abrasive material, a polishing coat encapsulating the abrasive material and an instruction card coupled to the polishing coat. The abrasive material having a property of conforming to the shape of a pointed article penetrating the abrasive material and a property of applying resistance pressure to the pointed article. The sharpening pad may be used in the sharpening and polishing of conically and other shaped points as found on various articles such as machine and hand sewing needles, quilting needles, pins, darts, miscellaneous tools, barb-less fishhooks and the like, including various fine pointed articles.

17 Claims, 3 Drawing Sheets

DEVICE FOR SHARPENING AND POLISHING NEEDLES, PINS, AND MISCELLANEOUS POINTED ARTICLES

FIELD OF THE INVENTION

Embodiments of the invention disclosed herein relate generally to the field of sharpening. More particularly, embodiments of the invention relate to sharpening and polishing of conically or otherwise shaped points found on various pointed articles such as needles, pins, darts, and barb-less hooks.

BACKGROUND

Needles, pins and other pointed articles rely on their points being sharp to achieve their various functions. For example, a sewing needle that is not sharp will not penetrate fabric easily and will require the application of additional force. Additional force may damage the fabric, damage the object applying the force (such as a hand), or damage the needle itself, potentially rendering it useless. The need to apply additional force may also slow down the sewing process.

When a needle, pin or other pointed article loses its sharpness, its user is faced with the choice of replacing or sharpening the pointed article. Replacing the pointed article has several drawbacks. Replacing can be seen as an inefficient use or even a waste of resources. More frequent replacement requires more elaborate disposal and resupply solutions. These disadvantages can lead to yet another—users may not replace the pointed article as often as they should for maximum effectiveness.

Sharpening a dulled pointed article avoids the most of the drawbacks of replacement. However, if the method or device used is expensive, difficult or tedious, users may not sharpen the pointed article as often as they should. Common hand tools such as files or sharpening stones may be used to sharpen a pointed article, but are often ineffective due to the small size the pointed article. Rubbing a small pointed article such as a needle on a file or other sharpening surface will likely create an irregular point with flat spots that has very poor penetration qualities. Holding the needle and then rotating an abrasive surface around the point while applying uniform pressure is difficult to perform by hand and will also likely result in an irregular point.

Presently known art attempts to address these problems, but not with adequate success. The following represents a list of known related art:

| Reference: | Issued to: | Date of Issue/Publication: |
|---|---|---|
| U.S. Pat. No. 2,426,892 | Mayer et al. | Sep. 2, 1947 |
| U.S. Pat. No. 2,766,644 | Marks | Oct. 16, 1956 |
| U.S. Pat. No. 3,468,068 | Spruell | Sep. 23, 1969 |
| U.S. Pat. No. 2,465,442 | Gaylor | Mar. 29, 1949 |
| U.S. Pat. No. 4,069,528 | Newton et al. | Jan. 24, 1978 |
| U.S. Des. Pat. No. D297,209 | Cohen | Aug. 16, 1988 |
| U.S. Des. Pat. No. D337,253 | Glesser | Jul. 13, 1993 |
| U.S. Pat. No. 2,657,503 | Gaines | Nov. 3 1953 |
| U.S. Pat. No. 4,991,355 | Giles | Feb. 12, 1991 |
| U.S. Pat. No. 3,092,081 | Fraser | Jun. 4, 1963 |

The teachings of each of the above-listed citations (which do not themselves incorporate essential material by reference) are herein incorporated by reference. None of the above inventions and patents, taken either singularly or in combination, is seen to describe the instant invention as claimed.

U.S. Pat. No. 2,426,892 to Mayer et al. for a "Fishhook sharpener" issued Sep. 2, 1947 discloses a tapered recess used to receive a point for sharpening. With continued use the tapered recess will shortly abrade into a shape unable to support the sharpening process by allowing the point of the object to be sharpened to hit the bottom of the tapered recess, thus dulling the point. In addition, use of an abrasive material as disclosed in this reference will breakdown very quickly thus preventing the creation of a clean, sharp, crisp point.

U.S. Pat. No. 2,766,644 to Marks for a "Sharpening tool" issued Oct. 16, 1956 discloses using a coarse file section held in place against a "V" groove creating an inwardly extending slot having a tapered opening in which to place the objects point for sharpening. The problem with this design is the coarse file or abrasive section will create grooves in the needle or other type object causing stress fractures and failure under load conditions. Additionally, the "V" groove and abrasive plate relationship create a pinch point that will not allow the point to sharpen fully and will pinch, grip, and twist off the thin point as it is sharpened. Also, there is no provision for the expulsion of metal particles, abrasive particles, and broken tips as they are generated in the course of using this sharpening device. This will impede the successful sharpening of any object.

U.S. Pat. No. 3,468,068 to Spruell for a "Fishhook sharpener" issued Sep. 23, 1969 discloses the use of an abrasive conical socket in an attempt to create a method of sharpening a conical fishhook point. The actual result will be the creation of a dull fishhook conical point. There is nothing that prevents the hook point from rubbing on the bottom of the conical socket. Therefore, if a new fishhook were put through the sharpening process using this device it would be duller after the process than before using this device. Additionally, the complexity of design will create very expensive manufacturing costs for the task that it is capable of performing.

U.S. Pat. No. 2,465,442 to Gaylor for a "Phonograph needle sharpener" issued Mar. 29, 1949 and U.S. Pat. No. 4,069,528 to Newton et al. for a "Dart point sharpener and straightening device" issued Jan. 24, 1978 each disclose a "hone nest"—a cavity specially shaped to facilitate sharpening. The hone nest is designed to sharpen conical type points as with sewing needles, but can only sharpen a point that has the pre-sharpened exact shape of said hone nest. Given the various truncated and triangular shapes of the specialized sewing needles available and used today, this type of device is too limited as it is incapable of sharpening needle points of differing size and shape.

U.S. Design Pat. D297,209 to Cohen for a "Fishhook sharpener" issued Aug. 16, 1988 and U.S. Design Pat. D337,253 to Glesser for a "Ceramic blade and hook sharpener" issued Jul. 13, 1993 both show devices that are not easily used, requiring a high degree of eye-hand coordination skills for its use.

Complexity of design and material use are critical elements to consider in today's economy as it relates to manufacturing costs along with the current competitive nature of offshore manufacturing. U.S. Pat. No. 2,657,503 to Gaines for a "Fishhook sharpener" issued Nov. 3, 1953 shows a device of extreme complexity. The fact that it is a machined assembly makes the manufacturing costs prohibitive in today's economy. Despite its complexity, this device cannot dress a conical tapered point as required on many sewing needles and pins. It can only sharpen one surface area of the point, producing a spade or shovel type point.

U.S. Pat. No. 4,991,355 to Giles for an "Apparatus for sharpening points" issued Feb. 12, 1991 and U.S. Pat. No. 3,092,081 to Fraser for a "Sharpener" issued Jun. 4, 1963 disclose devices that are additional examples of products that are extremely expensive to manufacture. These devices are capable of sharpening a conical point on a stationary held object using reciprocating and rotary abrasive elements driven by a battery powered motor.

In summary, the art commented on above employs designs and materials that are marginal at best in performance, operation, and in some cases, useful product life. The wrong materials for the application and over complexity of mechanical design for the desired application can make these previous designs undesirable.

SUMMARY AND ADVANTAGES

Described herein is a sharpening pad device with an abrasive material, a polishing coat encapsulating the abrasive material and an instruction card coupled to the polishing coat. The abrasive material having a property of conforming to the shape of a pointed article penetrating the abrasive material and a property of applying resistance pressure to the pointed article. The sharpening pad may be used in the sharpening and polishing of conically and other shaped points as found on various articles such as machine and hand sewing needles, quilting needles, pins, darts, miscellaneous tools, barb-less fishhooks and the like, including various fine pointed articles.

Advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

An embodiment of the present invention is illustrated by way of example and not limitation in the figures of the accompanying drawings, in which like references indicate similar elements and in which.

REFERENCE NUMBERS USED IN DRAWINGS

Figure 1:
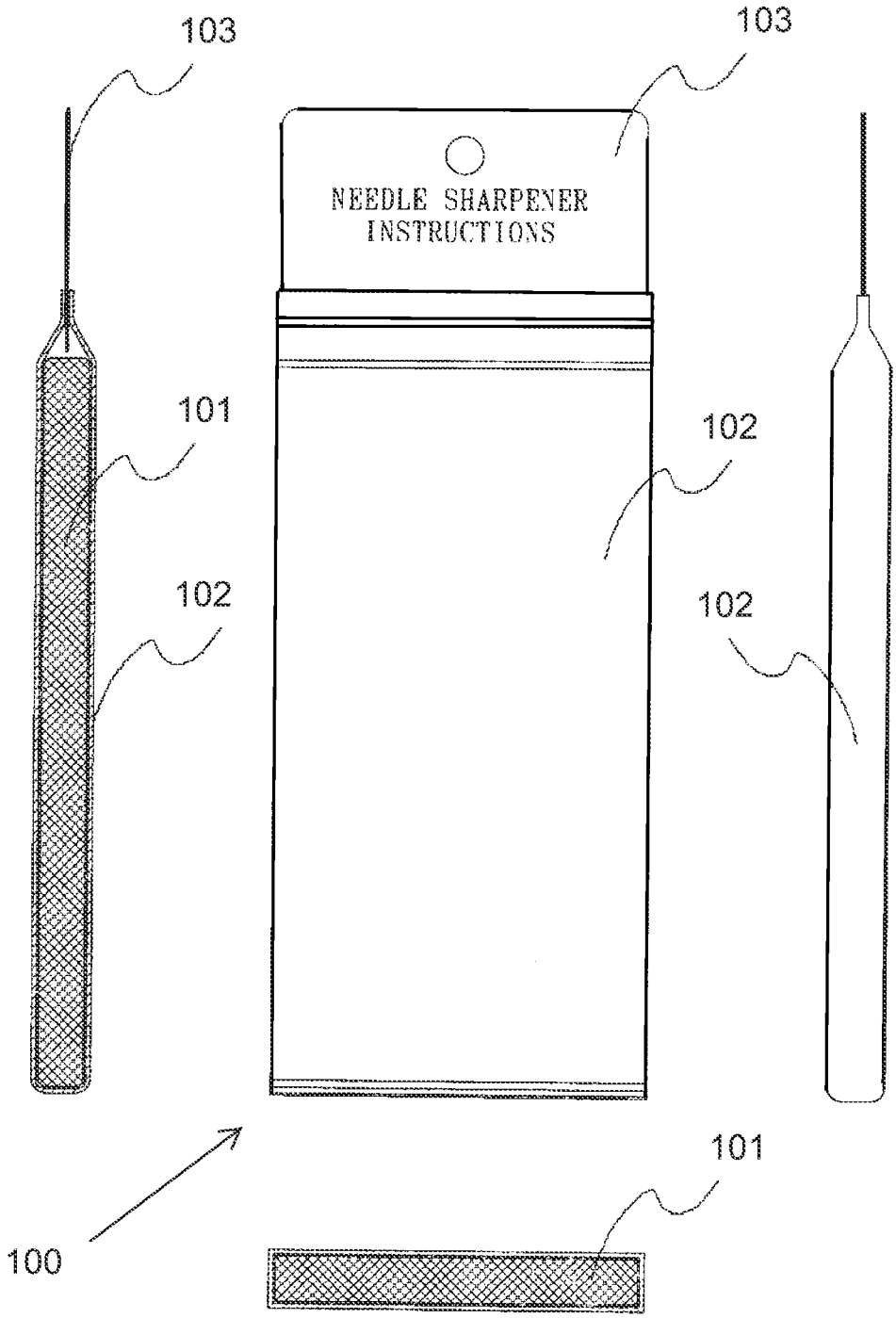
FIG. 1 shows side, top, and end views of the sharpening pad.

Turning now descriptively to the drawings, in which similar reference characters denote similar elements throughout the several views, the figures illustrate the non-opaque junction box cover and troubleshooting electronic circuit board for a vehicle junction box of the present invention. With regard to the reference numerals used, the following numbering is used throughout the various drawing figures:

| | |
|---|---|
| 100 | Sharpener pad |
| 101 | Abrasive material |
| 102 | Polishing coat |
| 103 | Instruction card |
| 104 | Hand |
| 105 | Other hand |
| 106 | Hand-held needle |
| 107 | Sewing machine |
| 108 | Sewing Machine Needle |

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

One or more embodiments of the present invention are described herein. In the following description, for purposes of explanation, numerous specific details are set forth in order to provide a thorough understanding of these embodiments. It will be evident to one skilled in the art that the present invention may be practiced without some of these details. On the other hand, to avoid obscuring the invention, in describing some embodiments, certain details necessary for a functioning device are not shown, but one skilled in the art would understand these necessary details are present.

Reference to "one embodiment" or "an embodiment" in the description of a particular feature, structure, or characteristic means that the particular feature, structure, or characteristic described is included in at least one embodiment of the invention. The appearances of the phrase "in one embodiment" in various places in the specification are not necessarily all referring to the same embodiment.

An embodiment of Applicant's invention, a sharpening pad 100 for sharpening and polishing conical shaped points on pins, darts, needles, and other miscellaneous pointed articles, is shown in FIG. 1 in front, side and end views. The sharpening pad 100 includes an abrasive material 101, a polishing coat 102; and an instruction card 103. The sharpening pad 100 is configured to sharpen a pointed article that has a long slender body with a taper to a point, such as a sewing needle or a pin.

The abrasive material 101 is composed of a unique, highly conformable, non-woven type of foam matrix impregnated with abrasive substances suspended within, and held in position by, a retaining substance such as an adhesive. The abrasive material 101 has a conforming property and a pressure applying property. Suitable abrasive substances include silicon carbide, also known as carborundum and other similar materials know to those of skill in the art. In an embodiment of Applicant's invention, the abrasive material 101 is SCOTCH-BRITE pad #7488 from 3M Company of St. Paul, Minn., a conformable, 3-dimensional nylon fiber web material, impregnated with aluminum oxide abrasive.

The conforming property of the abrasive material 101 is a property of a material that causes it to conform to the shape of a pointed article penetrating it. The abrasive material 101 compresses when the pointed article penetrates it and springs back when the pointed article is withdrawn. This conforming property of the abrasive material 101 provides for 360 degrees of contact between the pointed article and the abrasive material 101. This allows the sharpening pad 100 to sharpen pointed objects with points of many different shapes—conic, pyramid, etc.

The pressure applying property of the abrasive material 101 is a property of a material that applies pressure to a pointed article penetrating it. The pressure applying property includes providing an increased resistance pressure when the material is compressed. The abrasive material 101 provides very little resistance force when initially penetrated by the pointed article because the uncompressed abrasive material provides low (under a five pounds P.S.I. range) resistance pressure and because the point of the pointed article provides little surface area normal to the direction of penetration. This minimizes the likelihood of blunting or breaking the point of the pointed article. As more of the pointed article penetrates, larger cross-sections of the pointed article enter the abrasive material 101, compressing it. Portions of the pointed article with larger cross-sections will encounter more (but still within the five pounds P.S.I range) resistance pressure than portions of the pointed article with smaller cross-sections. This resistance pressure is normal to the surface of the pointed article.

As the pointed article penetrates into the abrasive material 101, the abrasive material conforms to the pointed article and applies resistance pressure. Contact with the abrasive material 101 in combination with the applied resistance pressure grinds off small pieces of the pointed article as it slides by. Portions of the pointed article with larger cross-sections will experience a higher rate of abrasion because they experience greater resistance pressure. This differential abrasion sharpens the pointed article. Repeatedly penetrating and withdrawing the pointed article into and out of the abrasive material 101 will increase the sharpness of the pointed article.

The abrasive material 101 in the embodiment shown in FIG. 1 has a shape of a thin rectangular box. However, persons of skill in the art will understand that other shapes may be used. The abrasive material 101 is of a size convenient to hold in a human hand—about 5 inches high by 4 inches wide by ½ inch deep. The dimensions of the sharpening pad 100 are not much different than the dimensions of the abrasive material 101. The thin depth (about ½ inch) of the abrasive material 101 allows the sharpening pad 100 to be inserted into most commercially available sewing machines like a piece of fabric. However, persons of skill in the art will understand that other size and dimensions may be used.

The polishing coat 102 is a covering that encapsulates the abrasive material 101. In some embodiments, the polishing coat 102 is constructed from a material such as treated cloth, flexible plastic or other suitable material such as a good quality, tight, felt material of the correct thickness and weight as used for milling machine and lathe way wiping and polishing. In other embodiments, the polishing coat 102 is a coating applied to the outer surface of the abrasive material 101.

The polishing coat 102 has a low friction pressure property (under a five pounds P.S.I. range) to allow for easy movement of the sharpening pad 100 across a support surface of a sewing machine while the sharpening pad 100 is sharpening the sewing machine's needle.

The polishing coat 102 is constructed to retain any residue abrasive material that may come loose from the inner abrasive pad. The polishing coat 102 also wipes off any object being sharpened to keep the object clean of all abrasive material that could be transferred to a project being worked on and possibly create a stain. As such, the polishing coat 102 serves to make the sharpening process cleaner in general. In particular, it prevents residue abrasive material from working its way into a sewing machine drive system.

The polishing coat 102 serves to polish an object being sharpened. In some embodiments, polishing is accomplished through the pressure applied by a close weave polishing coat such as a good quality, tight, felt material of the correct thickness and weight as used for milling machine and lathe way wiping and polishing of the 102 material. In some embodiments, the polishing coat 102 has a polishing substance applied to it that aids in cleaning and polishing as the needle or other object passes through, such as a wax based polishing substance that will lubricate as well as enhance the luster of the metal surface of the needle or other object being processed. Persons of skill in the art will know of appropriate polishing substances.

The instruction card 103 is attached to the polishing coat 102. In other embodiments, the instruction card 103 is attached to the abrasive material 101. The instruction card 103 is constructed from a suitable rigid material such as card stock or plastic or the like. The instruction card 103 serves to provide a surface to print the instructions on for easy access by the user. The instruction card 103 is firmly attached for quick reference and to prevent loss. However in other embodiments, the instruction card 103 is detachable. The instruction card 103 provides the function of a header card, whereby the product name is printed for advertisement to the customer, along with price markings, UPC code, and a hanger hole for display, thereby eliminating the requirement for costly additional packaging. In some embodiments, the sharpening pad 100 does not have an instruction card 103.

The sharpening pad 100 may be used in the sharpening and polishing conically and other shaped points as found on various pointed articles such as machine and hand sewing needles, quilting needles, pins, darts, miscellaneous tools, barb-less fishhooks and the like, including various fine pointed articles. The sharpening pad 100 is easy to use by the young, old or handicapped alike. With simple construction and materials, it is easy and inexpensive to manufacture.

Figure 2:
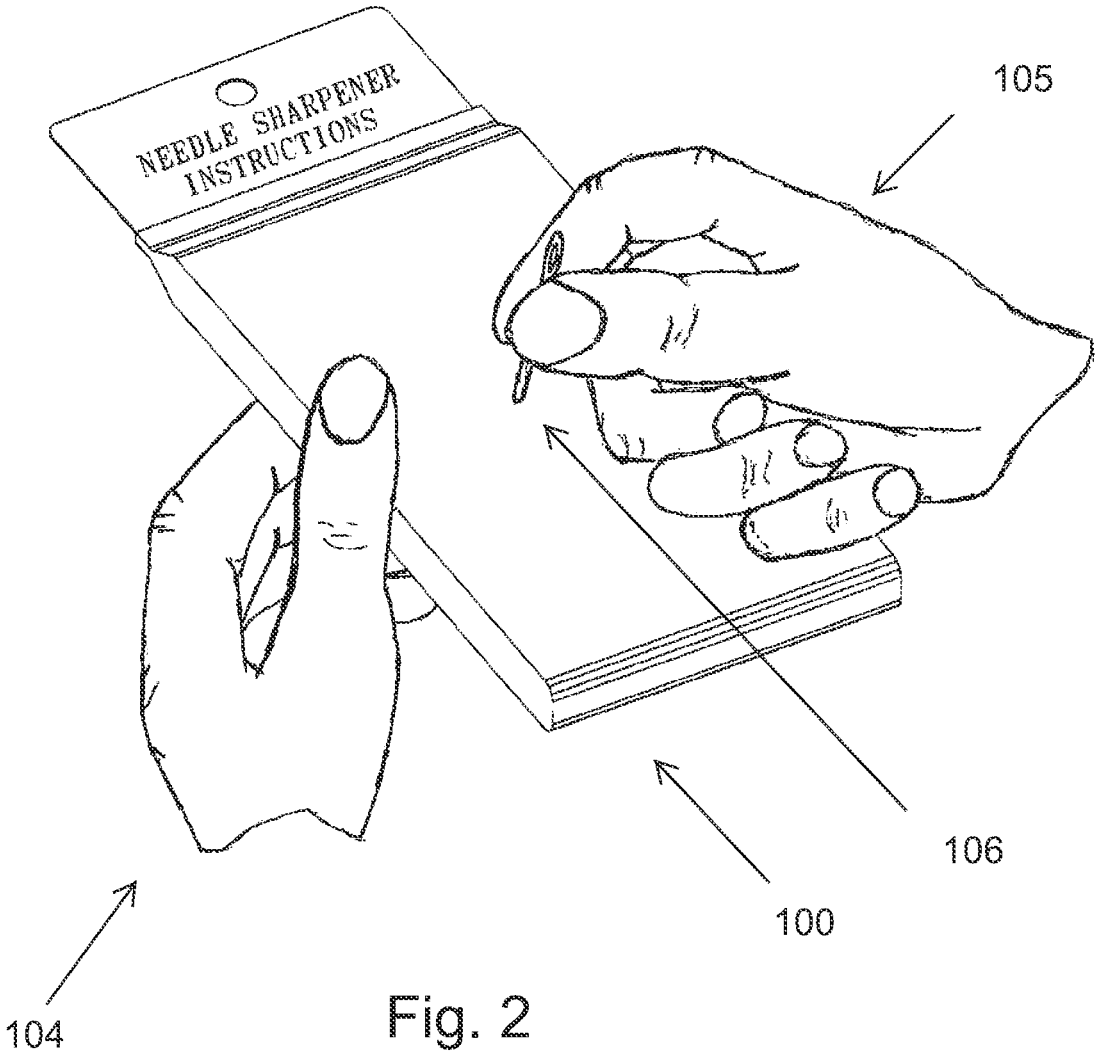
FIG. 2 is a perspective view showing use of the sharpening pad in sharpening a needle by hand.

FIG. 2 is a perspective view showing use of the sharpening pad 100 in sharpening a sewing needle 106 by hand. While the sharpening pad 100 is held in one hand 104, and the sewing needle 106 is held in the other hand 105 with the thumb and forefinger. The sewing needle 106 is then moved up and down through the sharpening pad 100, sharpening and polishing the sewing needle as described above in the discussion of FIG. 1.

Figure 3:
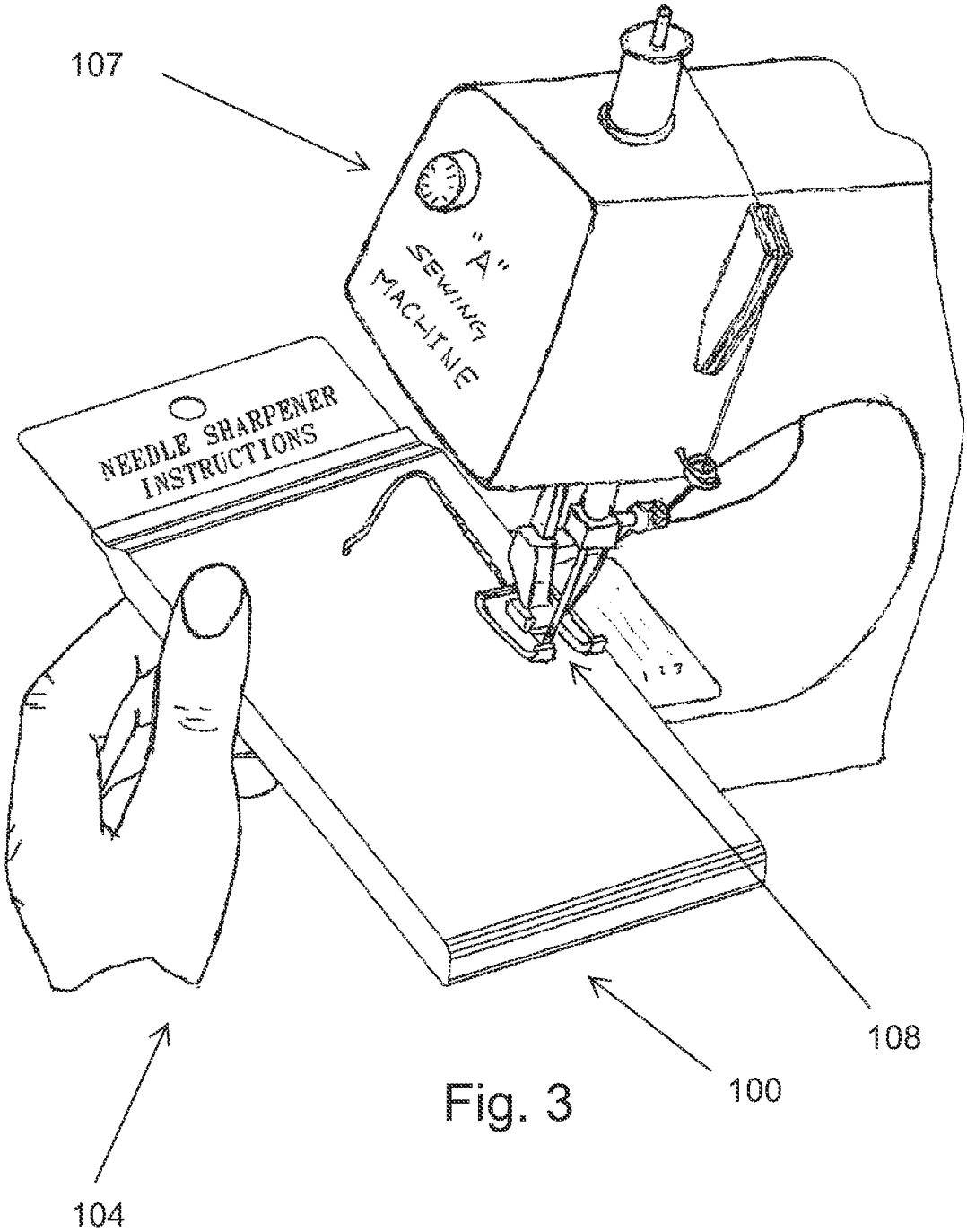
FIG. 3 is a perspective view showing use of the sharpening pad in sharpening a needle mounted to a sewing machine.

FIG. 3 is a perspective view showing use of the sharpening pad 100 in sharpening a sewing machine needle 108 while still mounted to a sewing machine 107. The sharpening pad 100 is grasped in one hand 104 and placed into the sewing machine 107 just as if the sharpening pad 100 were a piece of fabric to be sewn. The sewing machine 107 is then operated, causing the sewing machine needle 108 to repeatedly penetrate into and withdraw from the sharpening pad 100 thereby sharpening and polishing the sewing needle as described above in the discussion of FIG. 1. The sewing machine 107 feed mechanism advances the sharpening pad 100 through the sewing machine 107, allowing the sewing machine needle 108 to penetrate a different location on the sharpening pad 100 with each stitch. Alternatively, the user can move the sharpening pad 100 around while the sewing machine 107 operates with the feed mechanism disengaged.

Use of the sharpening pad 100 in a sewing machine 107 as described above saves significant time and expense. The sewing machine needle 108 does not have to be removed from the sewing machine 107 in order to sharpen it, saving the time not only of removing the sewing machine needle 108, but that of reinstalling it and rethreading it as well. Since this procedure is so much faster, users are more likely to sharpen their sewing machine needles 108 when dull, rather than attempting to continue sewing with a dull needle. This is likely to result in fewer broken needles and fewer instances of cloth damaged by broken needles.

The sewing machine needle 108 may be threaded or unthreaded while sharpening. Sharpening while threaded saves even more time, but will leave stitches in the sharpening pad 100. The sharpening pad 100 can accommodate many lines of stitches before becoming unusable. Since the sharpening pad 100 is inexpensive, it can then be discarded and a new sharpening pad 100 put into service.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

I claim:

1. A sharpening pad device comprising:

an abrasive material comprising 3-dimensional nylon fiber web material impregnated with aluminum oxide abrasive, wherein the abrasive material has a property of conforming to a pointed article that has a long slender body with a width of a typical sewing needle with a taper to a point penetrating the abrasive material, wherein the abrasive material has a property of applying a resistance pressure to the pointed article;

a polishing coat encapsulating the abrasive material, wherein the polishing coat comprises a close weave material configured to remove residual abrasive material from the pointed article when the pointed article is withdrawn from the abrasive material; and an instruction card coupled to the polishing coat.

2. The sharpening pad device of claim 1 wherein the abrasive material applies an increased resistance pressure to the pointed article when the abrasive material is compressed as compared to when the abrasive material is uncompressed.

3. The sharpening pad device of claim 1 wherein the polishing coat has a polishing substance applied.

4. A sharpening pad device comprising:

an abrasive material comprising 3-dimensional nylon fiber web material impregnated with aluminum oxide abrasive; and a polishing coat covering at least a portion of the abrasive material, wherein the polishing coat comprises a close weave material configured to remove residual abrasive material from a pointed article when the pointed article is withdrawn from the abrasive material, wherein the pointed article has a long slender body with a width of a typical sewing needle.

5. The sharpening pad device of claim 4 wherein the polishing coat encapsulates the abrasive material.

6. The sharpening pad device of claim 4 wherein the polishing coat has a low friction property.

7. The sharpening pad device of claim 4 wherein the polishing coat has a polishing substance applied.

8. The sharpening pad device of claim 4 wherein the abrasive material is composed of a matrix of selected abrasive substances suspended within a retaining substance.

9. The sharpening pad device of claim 4 wherein the abrasive material has a conforming property.

10. The sharpening pad device of claim 4 wherein the abrasive material has a pressure applying property.

11. The sharpening pad device of claim 4 wherein the abrasive material has a shape of a thin rectangular box.

12. The sharpening pad device of claim 4 wherein the abrasive material is of a size convenient to hold in a human hand.

13. The sharpening pad device of claim 4 further comprising an instruction card coupled to the polishing coat.

14. A sharpening pad device comprising:

an abrasive material comprising 3-dimensional nylon fiber web material impregnated with aluminum oxide abrasive;

a polishing coat encapsulating the abrasive material, wherein the polishing coat comprises a close weave material configured to remove residual abrasive material from a pointed article when the pointed article is withdrawn from the abrasive material, wherein the pointed article has a long slender body with a width of a typical sewing needle; and an instruction card coupled to the polishing coat.

15. The sharpening pad device of claim 14 wherein the abrasive material conforms to a shape of a pointed article penetrating the abrasive material.

16. The sharpening pad device of claim 14 wherein the abrasive material applies resistance pressure to a pointed article penetrating the abrasive material.

17. The sharpening pad device of claim 16 wherein the abrasive material applies an increased resistance pressure to the pointed article when the abrasive material is compressed as compared to when the abrasive material is uncompressed.

* * * * *